US008015914B2

(12) United States Patent
Huang

(10) Patent No.: US 8,015,914 B2
(45) Date of Patent: Sep. 13, 2011

(54) PNEUMATIC LIFT APPARATUS

(76) Inventor: Steve Huang, Shen Gang Hsiang (TW)

( * ) Notice: Subject to any disclaimer, the term of this patent is extended or adjusted under 35 U.S.C. 154(b) by 632 days.

(21) Appl. No.: 12/136,795

(22) Filed: Jun. 11, 2008

(65) Prior Publication Data

US 2009/0256050 A1 Oct. 15, 2009

(30) Foreign Application Priority Data

Apr. 11, 2008 (TW) ..... 97113206 A

(51) Int. Cl.
*F01B 29/00* (2006.01)
*F16M 11/24* (2006.01)

(52) U.S. Cl. ..... 92/165 PR; 248/188.2

(58) Field of Classification Search ..... 92/165 PR, 92/177; 248/161, 188.2, 404, 631; 297/344.18, 297/344.19
See application file for complete search history.

(56) References Cited

U.S. PATENT DOCUMENTS

| | | | | |
|---|---|---|---|---|
| 4,726,284 | A * | 2/1988 | Green | 92/165 PR |
| 5,531,413 | A * | 7/1996 | Wolf et al. | 248/188.2 |
| 5,944,290 | A * | 8/1999 | Fuhrmann et al. | 297/344.19 |
| 7,059,592 | B2 * | 6/2006 | Huh et al. | 297/344.19 |
| 7,328,875 | B2 * | 2/2008 | Kastner et al. | 248/161 |
| 7,497,413 | B2 * | 3/2009 | Pooschen | 248/631 |

FOREIGN PATENT DOCUMENTS

TW 579776 3/2004

* cited by examiner

*Primary Examiner* — Thomas E Lazo
(74) *Attorney, Agent, or Firm* — Alan Kamrath; Kamrath & Associates PA

(57) ABSTRACT

A pneumatic lift apparatus has a main body including a body tube, with a cross-section of the body tube being neither a perfect circle nor a polygon. A restricting device is slidably mounted on the body tube of the main body, with the body tube restricted not to rotate relative to the restricting device. The restricting device is coupled to an end of a housing, with the main body inserted through the restricting device and received in the housing, with the main body fixed in the housing opposite to the restricting device.

14 Claims, 13 Drawing Sheets

PNEUMATIC LIFT APPARATUS

BACKGROUND OF THE INVENTION

1. Field of the Invention

The invention relates to an elevation apparatus for a device such as an office chair, a leg of a table or things like that. More particularly, this invention relates to a pneumatic lift apparatus to hold a device, such as an office chair, a leg of a table or things like that, for a user to use while either sitting at the device or standing near the device.

2. Description of the Related Art

Pneumatic lift apparatus are usually adapted for elevation adjustment of a device such as an office chair, a leg of a table or things like that. A prior pneumatic lift apparatus as disclosed in Taiwan Patent No 579776 comprises a main body and an outer tube, with both the cross-section of the main body and the outer tube being a perfect circle. The main body is rotably received in the outer tube, so that the device connected to the main body can be driven to rotate. However, such pneumatic lift apparatus is not suitable for use with a device (such as an office chair or leg of a table or things like that) which is not rotatable. Therefore, another pneumatic lift apparatus comprises a main body and an outer tube, with both the cross-section of the main body and the outer tube being polygonal. Nevertheless, an expensive manufacturing process of the polygonal main body and outer tube is still one of the problems.

Therefore, the present invention is intended to obviate or at least alleviate the problems encountered in the prior art.

SUMMARY OF THE INVENTION

In one aspect embodiments of the present invention generally include a pneumatic lift apparatus for elevation adjustment of a device comprising an extendible main body having a body tube and a connected rod slidably received in the body tube. The cross-section of the body tube is neither a perfect circle nor a polygon. A restricting device has a through-hole therein, with the cross section of the through-hole being neither a perfect circle nor a polygon. A housing has a receptacle, with the restricting device mounted on the distal end of the receptacle, and with the main body inserted through the restricting device to the receptacle of the housing. The connected rod is fixed in the housing opposite to the receptacle, and the main body is slidably coupled with the restricting device so that the body tube is allowed to move longitudinally relative to the restricting device. While the main body is engaging with the restricting device, the outer periphery of the body tube exactly corresponds to the periphery of the through-hole of the restricting device so that the body tube is restricted not to rotate relative to the restricting device.

Another feature of this aspect of the present invention is that the restricting device is made of plastics, rubber or a material with plasticity and can be manufactured via injection-molding so that the manufacturing process of the restricting device is quick and economical.

Other objectives, advantages, and features of the invention will become more apparent from the following detailed description when taken in conjunction with the accompanying drawings.

BRIEF DESCRIPTION OF THE DRAWINGS

Preferred exemplary embodiments of the invention are illustrated in the accompanying drawings in which like reference numerals represent like parts throughout and in which.

DETAILED DESCRIPTION OF THE PREFERRED EMBODIMENT

Figure 1:
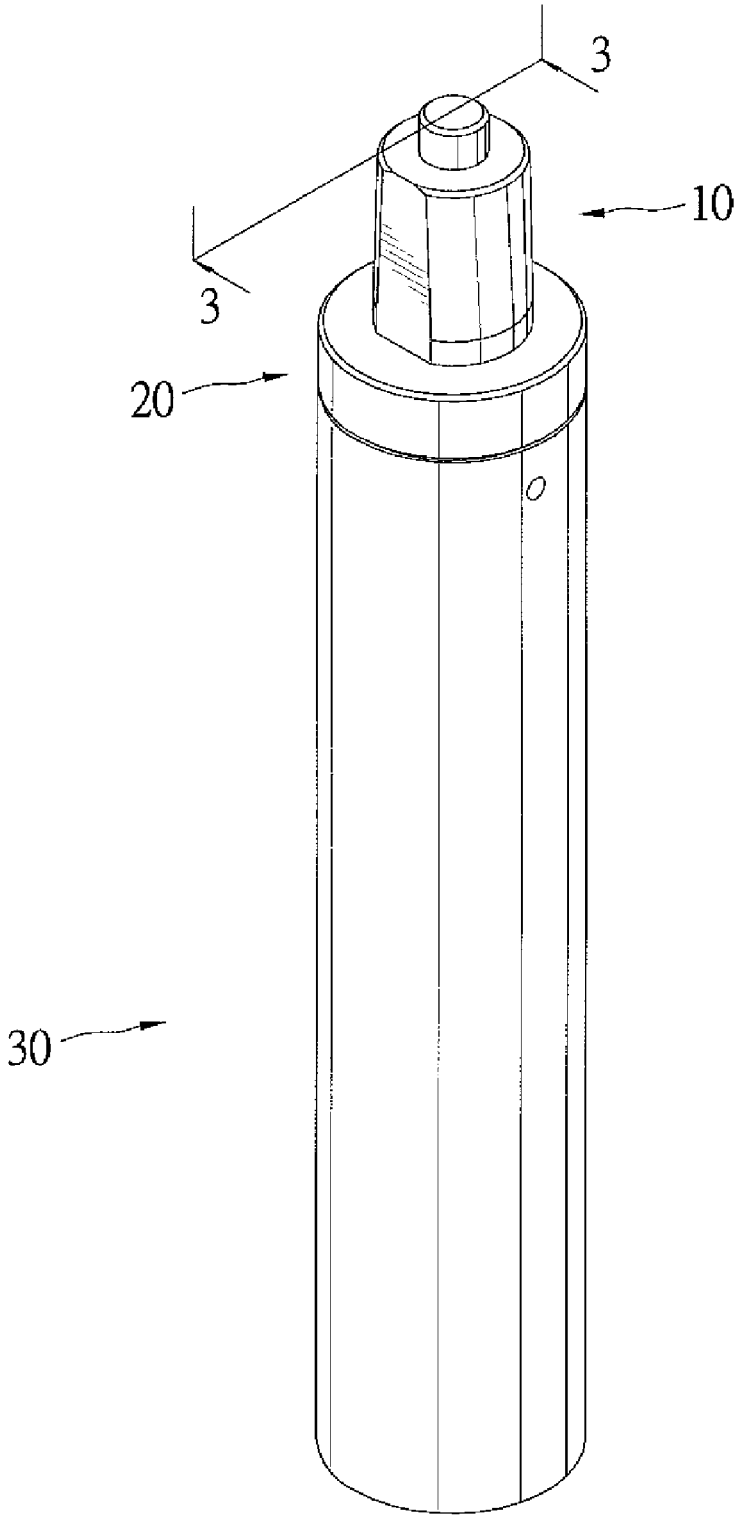
FIG. 1 is a perspective view of a pneumatic lift apparatus according to the first embodiment of the present invention.
Figure 2:
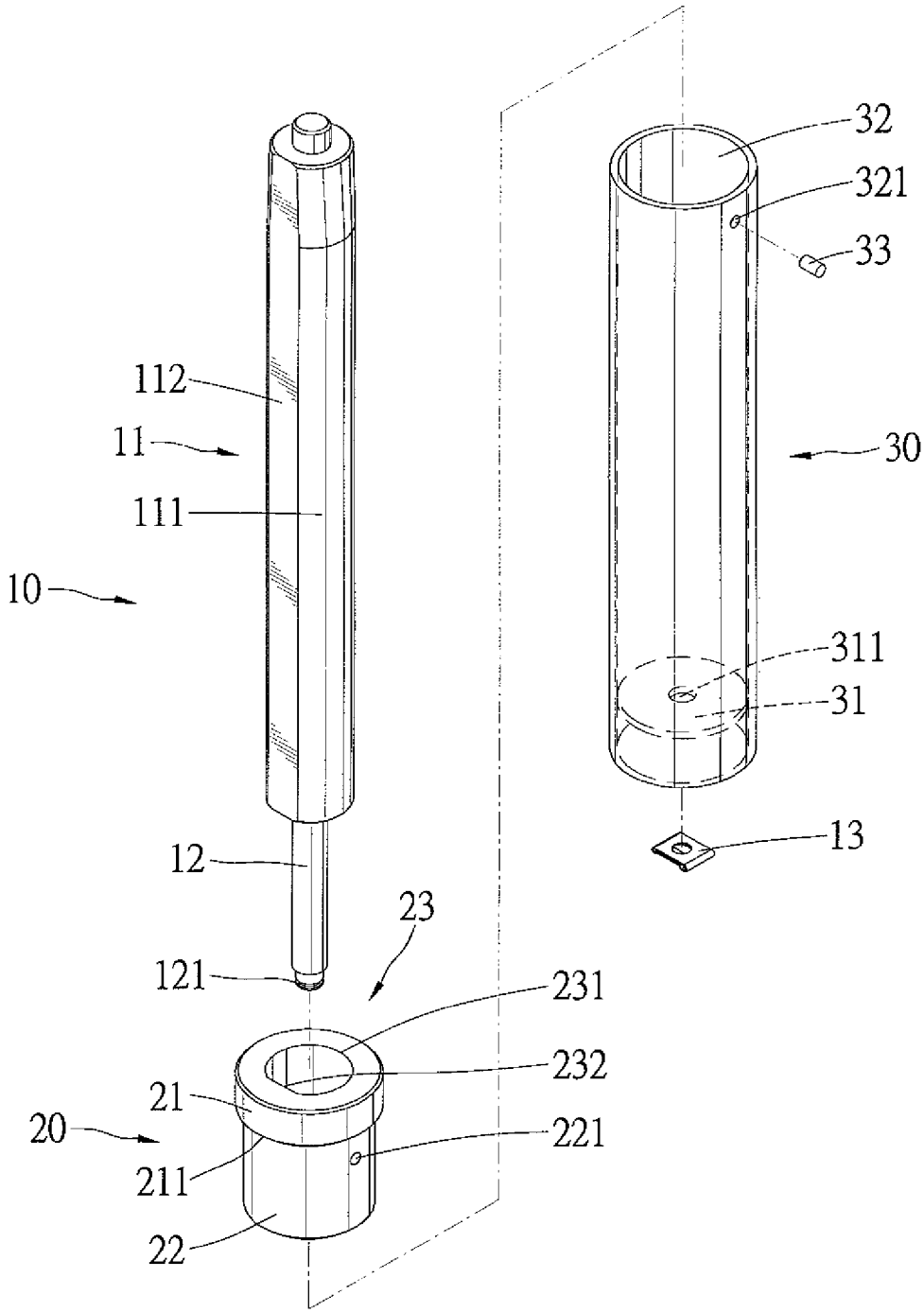
FIG. 2 is an exploded view of the pneumatic lift apparatus shown in FIG. 1.
Figure 3:
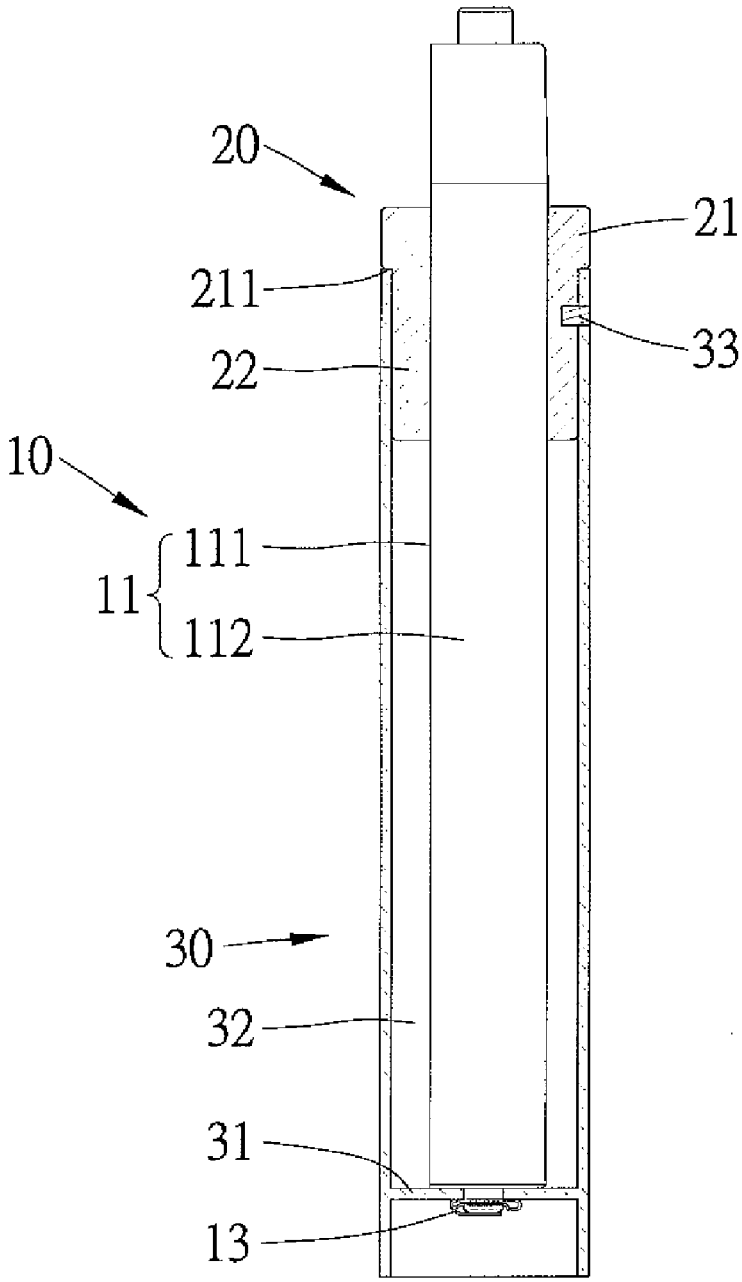
FIG. 3 is a cross-sectional view taken along 3-3 in FIG. 1.

Referring to FIGS. 1 through 3, a pneumatic lift apparatus in accordance with a first embodiment in the present invention includes a main body 10, a restricting device 20 and a housing 30. The length of the main body 10 is adjustable and includes a body tube 11 and a controlling rod 12 slidably received in the body tube 11. The cross-section of the body tube 11 is neither a perfect circle nor a polygon. The body tube 11 has an arcuate portion 111 and a flat portion 112 on the outer circumference thereof, with the arcuate portion 111 and the flat portion 112 contiguously connected to each other. A manufacturing process of the body tube 11 is preparing a perfect circle tube and then longitudinally cutting a side of the body tube 11 so that the flat portion 112 is formed. The manufacturing process of the body tube 11 is easy and simple. An end of the controlling rod 12 extends from the body tube 11, and a connected end 121 is defined on the end of the controlling rod 12. A connected element 13 is provided to connect to the connected end 121 of the controlling rod 12.

The restricting device 20 is preferably made of plastics, rubber or a material with plasticity and includes a first end 21 and a second end 22. Each of the cross-sections of the outer periphery of the first and second ends 21 and 22 is a perfect circle. A through-hole 23 longitudinally pierces the restricting device 20 through the first end 21 to the second end 22. The cross-section of the through-hole 23 is neither a perfect circle nor a polygon, and the shape of the cross-section of the through-hole 23 corresponds to that of the body tube 11. An arcuate portion 231 and a flat portion 232 form the periphery of the through-hole 23 and correspond to the arcuate portion 111 and the flat portion 112, respectively. An outer diameter of the first end 21 is larger than that of the second end 22 so that the difference between the diameter of the first and second ends 21 and 22 forms an abutted periphery 211 defined on the first end 21. An orifice 221 is provided on the outer periphery of the second end 22 axially and does not communicate with the through-hole 23. The restricting device 20 and the through-hole 23 can be made via injection-molding so that the manufacturing process of the restricting device 20 is quick and economical.

The housing 30 includes a limited portion 31 provided in the interior thereof and a receptacle 32 opposite to the limited portion 31. The limited portion 31 is adjacent to a first end of the housing 30. The receptacle 32 is open to a second end of the housing 30. An opening (not numbered) which is open to the first end of the housing 30 and opposite to the receptacle 32 abuts against the limited portion 31. The limited portion 31, which is in form of a perfect circle, is integrally formed with the inner wall of the housing 30 and includes an aperture 311 defined on the center thereof. The cross-section of the receptacle 32 is a perfect circle, with the second end 22 of the restricting device 20 fitting inside the receptacle 32. An orifice 321 is defined on the outer wall of the receptacle 32 adjacent to the second end of the housing 30.

The restricting device 20 is mounted on the second end of the housing 30, and the orifice 321 of the housing 30 corresponds to the orifice 221 of the restricting device 20. A fixed element 33 is adapted for inserting through the orifice 321 of the housing 30 to the orifice 221 of the restricting device 20 as to fix the restricting device 20 to the housing 30 and prevent disengagement of the restricting device 20 from the housing 30. The resilience of the restricting device 20, also, can increase the attachment force between the restricting device 20 and the housing 30. Further, the abutted periphery 211 is adapted to abut with the second end of the housing 30 for preventing the whole restricting device 20 from sliding into the receptacle 32.

The main body 10 is inserted through the restricting device 20 to the receptacle 32 of the housing 30. The distal end of the body tube 11 is abutted against the limited portion 31. Then, the controlling rod 12 slightly extending from the body tube 11 and the connected end 121 pierces through the aperture 311 of the limited portion 31. A connected element 13 is provided in the opening of the housing 30 and opposite to the main body 10 for engaging with the connected end 121 as to prevent the controlling rod 12 longitudinally moving relative to the housing 30.

Figure 4:
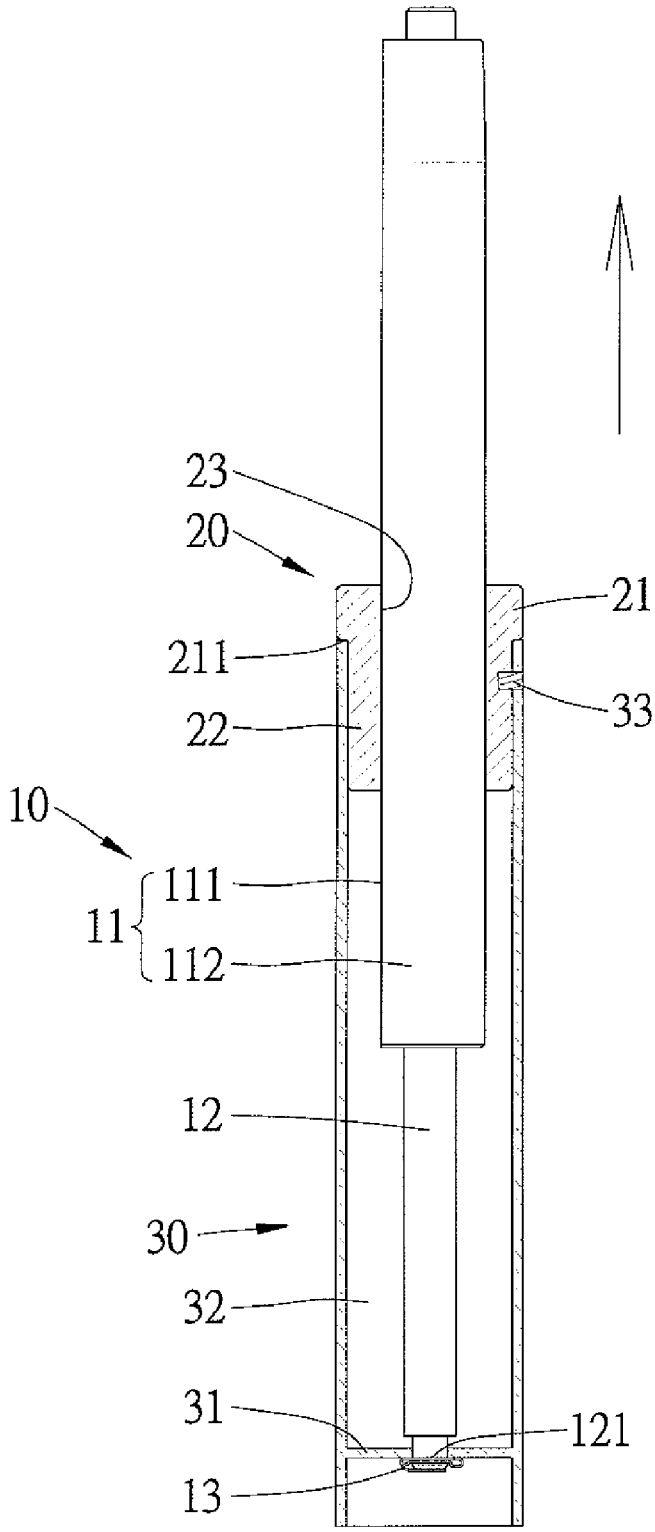
FIG. 4 is another cross-sectional view similar to FIG. 3, illustrating the body tube of the main body extending outwardly relative to the housing and the restricting device.

The through-hole 23 is engaged with the body tube 11 in place, and the main body 10 is slidably coupled with the restricting device 20 so that the body tube 11 is allowed to move longitudinally relative to the restricting device 20 (as shown in FIG. 4). While the main body 10 is engaging with the restricting device 20, the arcuate and flat portions 111 and 112 of the body tube 11 abut with the arcuate and flat portions 231 and 232 of the through-hole 23, respectively, so that the body tube 11 is restricted not to rotate relative to the restricting device 20.

Figure 5:
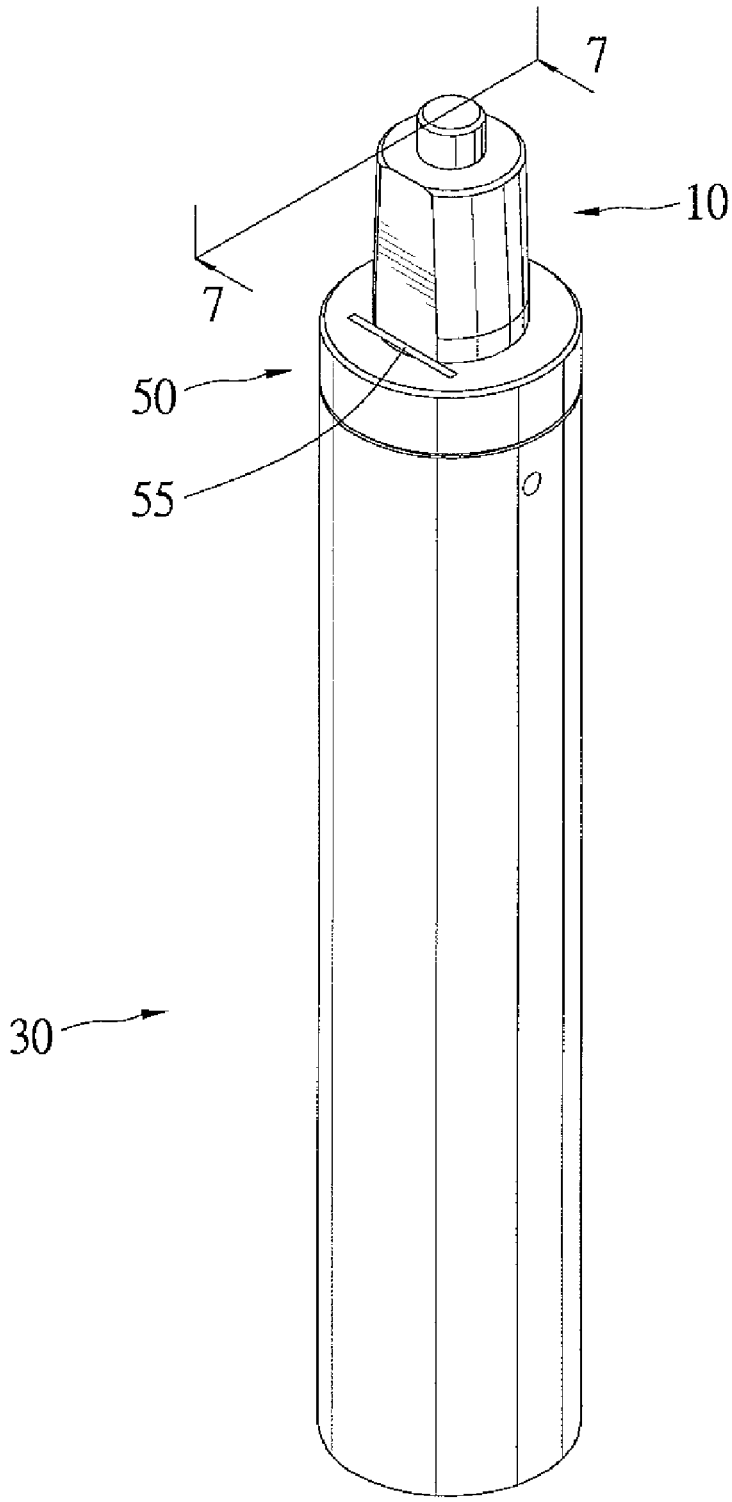
FIG. 5 is a perspective view of a pneumatic lift apparatus according to the second embodiment of the present invention.
Figure 6:
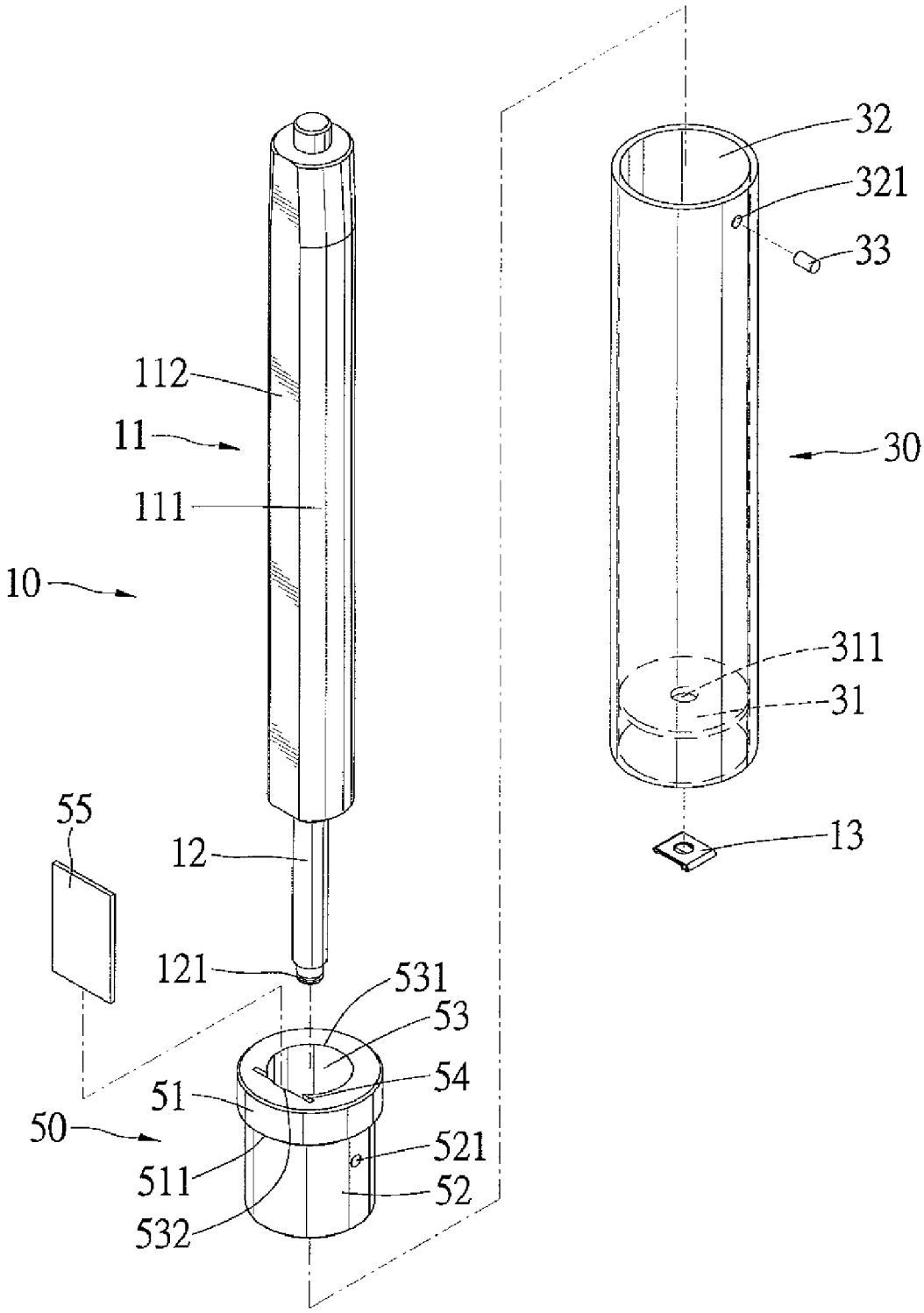
FIG. 6 is an exploded view of the pneumatic lift apparatus shown in FIG. 5.
Figure 7:
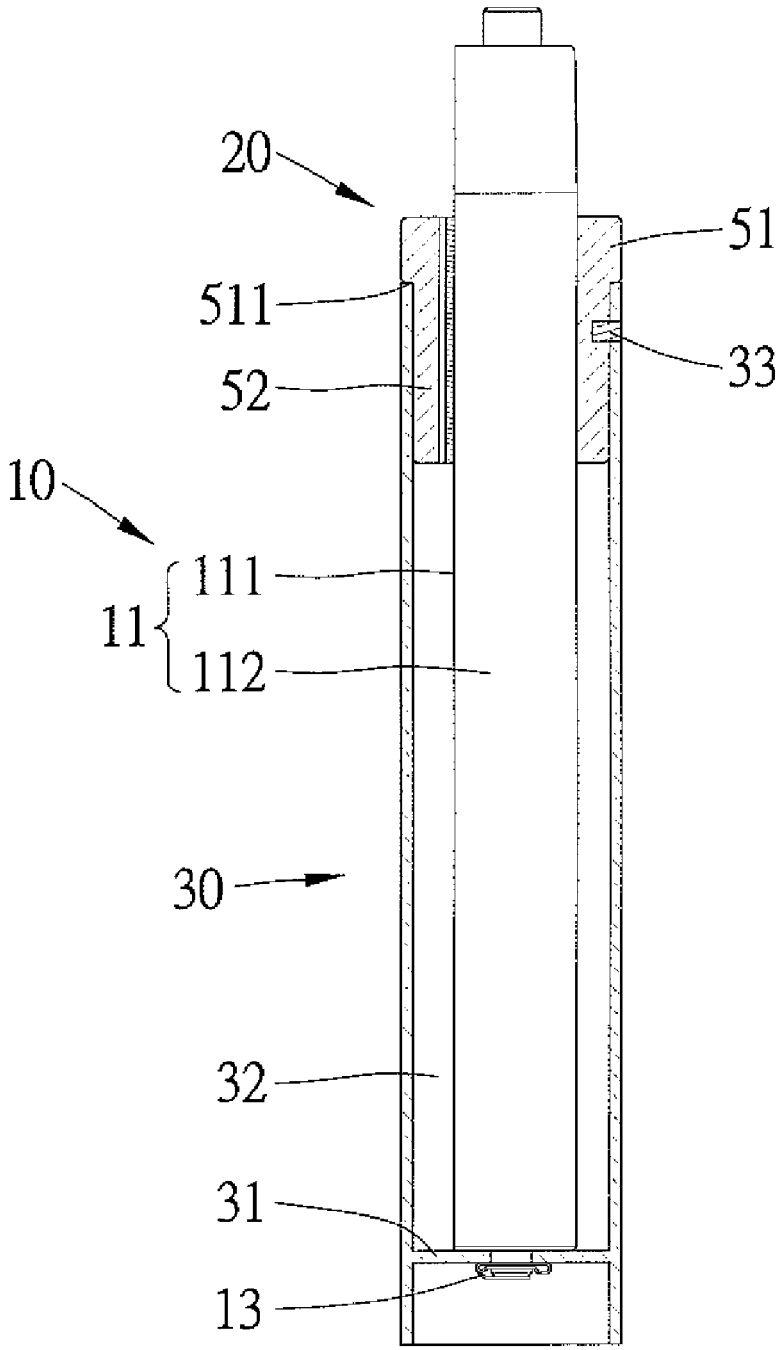
FIG. 7 is a cross-sectional view taken along 7-7 in FIG. 5.

Referring to FIGS. 5 through 7, a pneumatic lift apparatus in accordance with a second embodiment in the present invention includes the main body 10, a restricting device 50 and the housing 30. In this embodiment, the main body 10 and the housing 30 are the same to that in the first embodiment, but the restricting device 50 replaces the restricting device 20. The restricting device 50 is preferably made of plastics, rubber or a material with plasticity and includes a first end 51 and a second end 52. Each of the cross-sections of the outer periphery of the first and second ends 51 and 52 is a perfect circle. The second end 52 of the restricting device 50 is fit for the receptacle 32. Both a through-hole 53 and a groove 54 longitudinally pierce the restricting device 50 through the first end 51 to the second end 52. The cross-section of the through-hole 53 is a perfect circle. The groove 54 is provided on a side of the through-hole 53 and partitions the inner periphery of the through-hole 53 into first and second arcuate portions 531 and 532. The first arcuate portion 531 corresponds to the arcuate portion 111. A flat piece 55 is disposed in the groove 54 and corresponds to the flat portion 112. The flat piece 55 is preferably made of metal. Due to the resilience of the restricting device 50, the flat piece 55 is tightly engaged with the groove 54 and does not detach from the restricting device 50.

An outer diameter of the first end 51 is larger than that of the second end 52 so that the difference between the diameter of the first and second ends 51 and 52 forms an abutted periphery 511 defined on the first end 51. An orifice 521 is provided on the outer periphery of the second end 52 axially and does not communicate with the through-hole 53. The restricting device 50 can be made via injection-molding so that the manufacturing process of the restricting device 50 is quick and economical.

The restricting device 50 is mounted on the second end of the housing 30, and the orifice 321 of the housing 30 corresponds to the orifice 521 of the restricting device 50. The fixed element 33 is adapted for inserting through the orifice 321 of the housing 30 to the orifice 521 of the restricting device 50 as to fix the restricting device 50 to the housing 30 and prevent disengagement of the restricting device 50 from the housing 30. The resilience of the restricting device 50, also, can increase the attachment force between the restricting device 50 and the housing 30. Further, the abutted periphery 511 is adapted to abut with the second end 52 of the housing 30 for preventing the whole restricting device 50 from sliding into the receptacle 32.

The main body 10 is inserted through the restricting device 50 to the receptacle 32 of the housing 30. Incorporation of the through-hole 53 and the flat piece 55 is engaged with the body tube 11 in place, and the main body 10 is slidably coupled with the restricting device 50 so that the body tube 11 is allowed to move longitudinally relative to the restricting device 50. While the main body 10 is engaging with the restricting device 50, the arcuate and flat portions 111 and 112 of the body tube 11 abut with the first arcuate portion 531 of the through-hole 53 and the flat piece 55, respectively so that the body tube 11 is restricted not to rotate relative to the restricting device 50.

Figure 8:
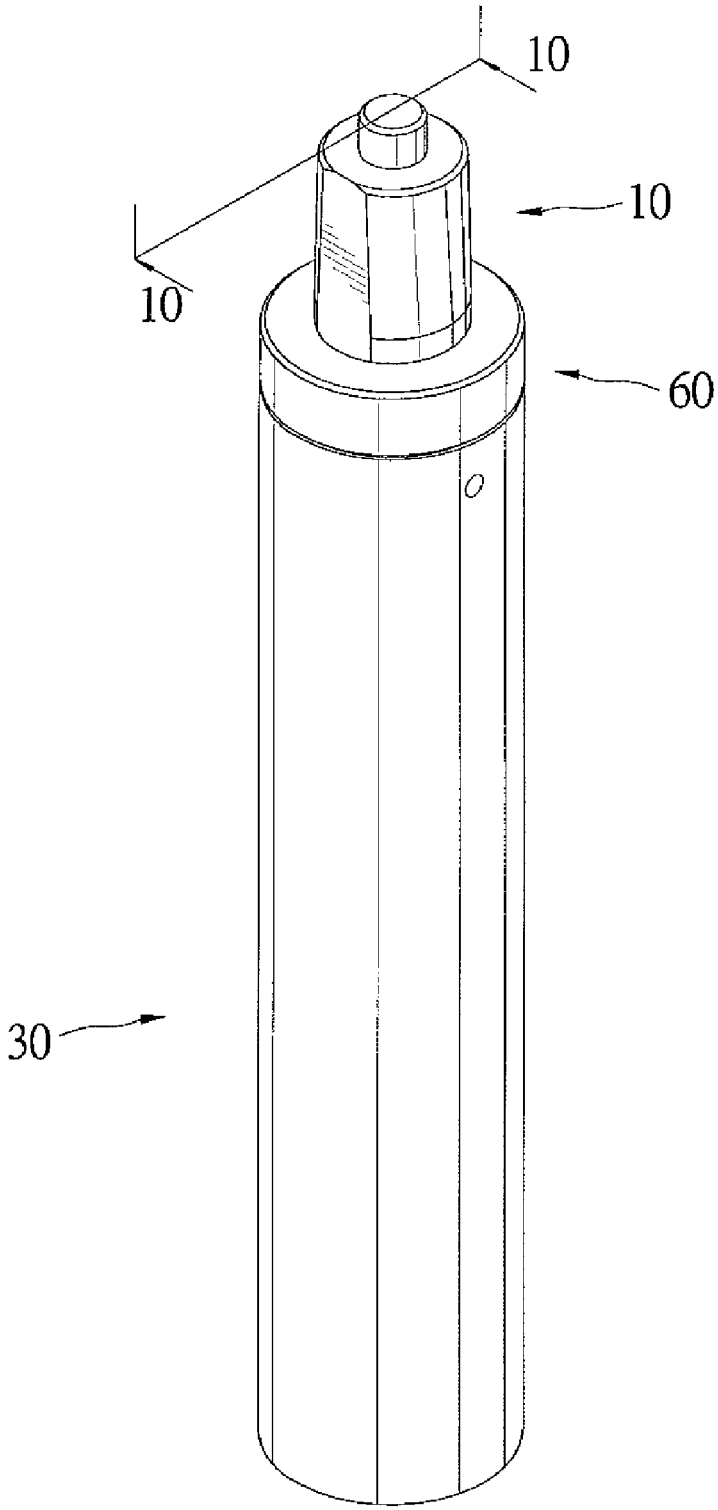
FIG. 8 is a perspective view of a pneumatic lift apparatus according to the third embodiment of the present invention.
Figure 9:
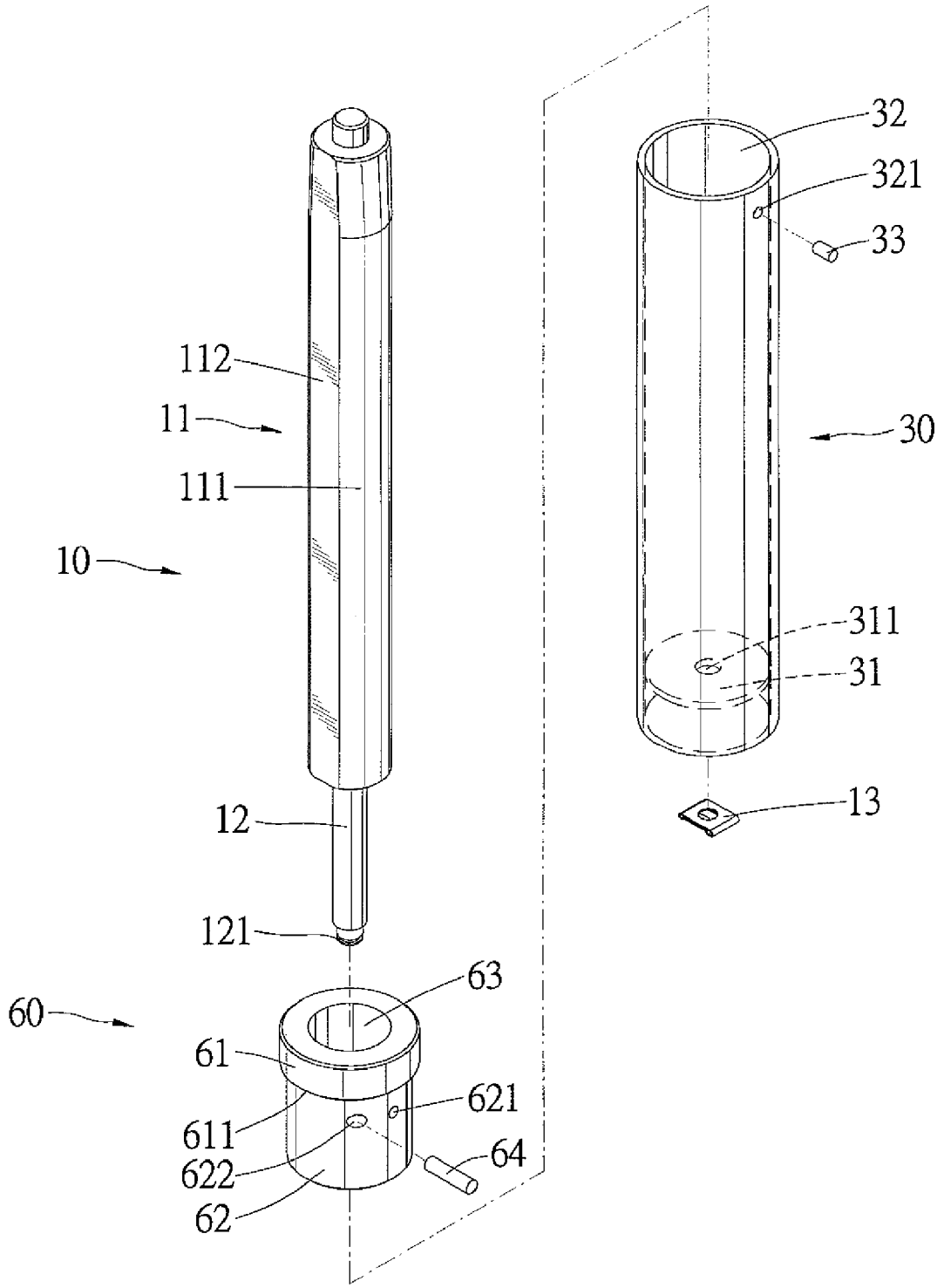
FIG. 9 is an exploded view of the pneumatic lift apparatus shown in FIG. 8.
Figure 10:
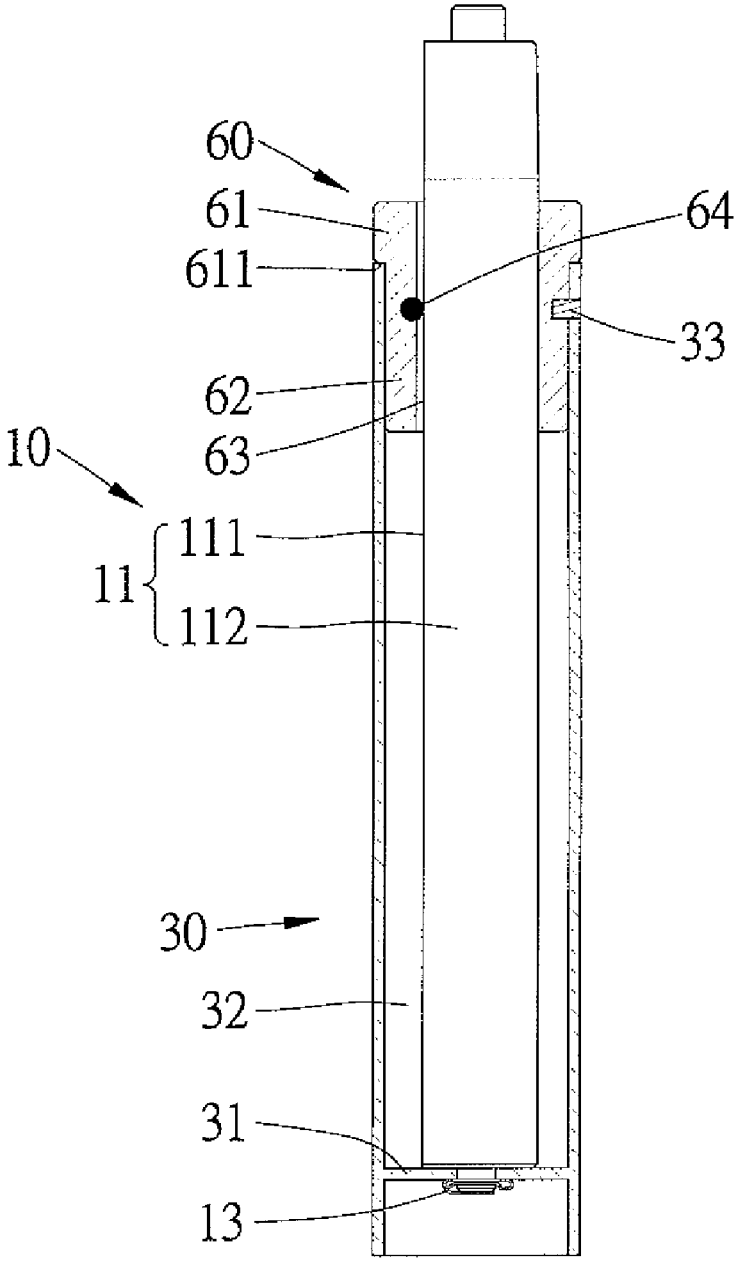
FIG. 10 is a cross-sectional view taken along 10-10 in FIG. 8.

Referring to FIGS. 8 through 10, a pneumatic lift apparatus in accordance with a third embodiment in the present invention includes the main body 10, a restricting device 60 and the housing 30. In this embodiment, the main body 10 and the housing 30 are the same to that in the first embodiment, but the restricting device 60 replaces the restricting device 20. The restricting device 60 is preferably made of plastics, rubber or a material with plasticity and includes a first end 61 and a second end 62. Each of the cross-sections of the outer periphery of the first and second ends 61 and 62 is a perfect circle. The second end 62 of the restricting device 60 fits inside the receptacle 32. A first through-hole 63 longitudinally pierces the restricting device 60 through the first end 61 to the second end 62. The cross-section of the first through-hole 63 is a perfect circle.

An outer diameter of the first end 61 is larger than that of the second end 62 so that the difference between the diameter of the first and second ends 61 and 62 forms an abutted periphery 611 defined on the first end 61. An orifice 621 is provided on the outer periphery of the second end 62 axially and does not communicate with the first through-hole 63. A second through-hole 622 transversely pierces the second end 62 of the restricting device 60 and communicates with the first through-hole 63. A fixed pin 64 is disposed in the second through-hole 622 and is partially exposed in the first through-hole 63. The restricting device 60 can be made via injection-molding so that the manufacturing process of the restricting device 60 is quick and economical.

The restricting device 60 is mounted on the second end of the housing 30, and the orifice 321 of the housing 30 corresponds to the orifice 621 of the restricting device 60. The fixed element 33 is adapted for inserting through the orifice 321 of the housing 30 to the orifice 621 of the restricting device 60 as to fix the restricting device 60 to the housing 30 and prevent disengagement of the restricting device 60 from the housing 30. Moreover, two ends of the second through-hole 622 are closed via the receptacle 32 of the housing 30 as to prevent the fixed pin 64 detaching from the through-hole 622. The resilience of the restricting device 60, also, can increase the attachment force between the restricting device 60 and the housing 30. Further, the abutted periphery 611 is adapted to abut with the second end of the housing 30 for preventing the whole restricting device 60 from sliding into the receptacle 32.

The main body 10 is inserted through the restricting device 60 to the receptacle 32 of the housing 30. Incorporation of the first through-hole 63 and the fixed pin 64 is engaged with the body tube 11 in place, and the main body 10 is slidably coupled with the restricting device 60 so that the body tube 11 is allowed to move longitudinally relative to the restricting device 60. While the main body 10 is engaging with the restricting device 60, the fixed pin 64 abuts with the flat portion 112 of the body tube 11 with a line-contact so that the body tube 11 is restricted not to rotate relative to the restricting device 60.

Figure 11:
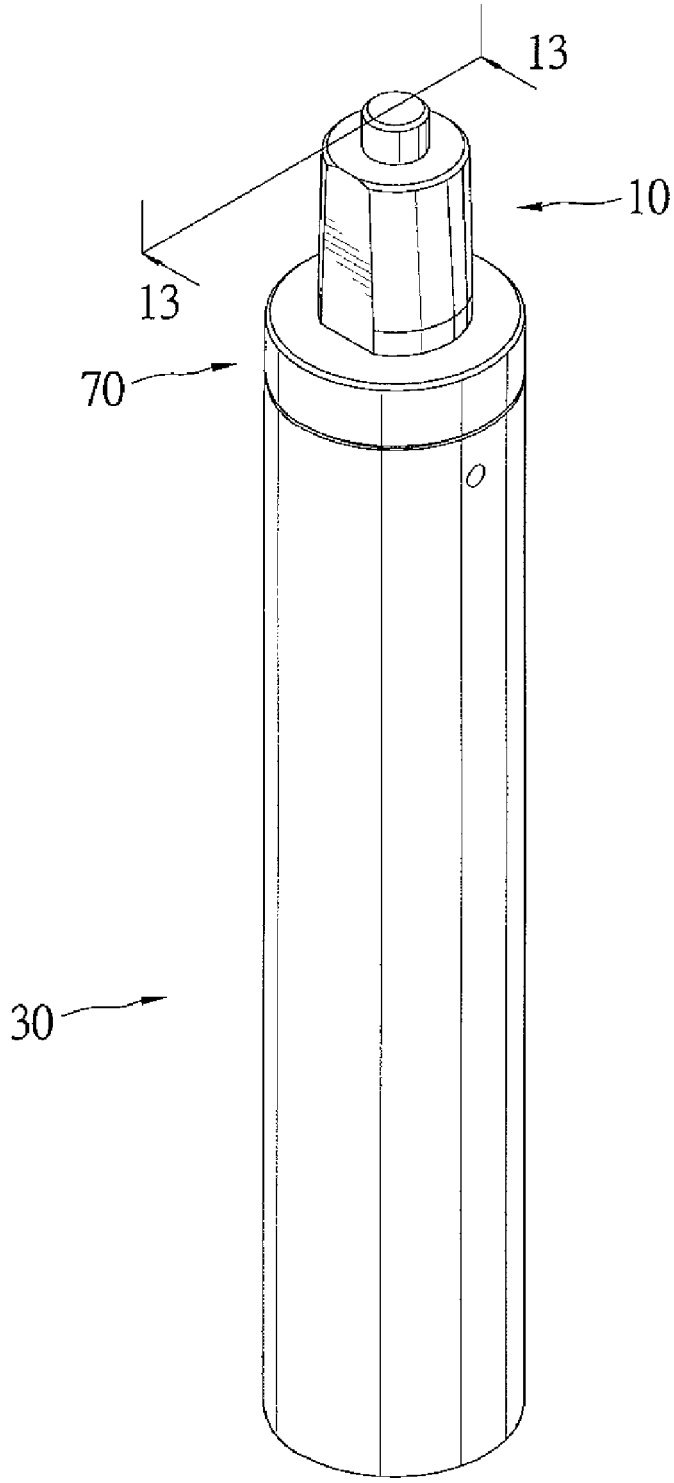
FIG. 11 is a perspective view of a pneumatic lift apparatus according to the fourth embodiment of the present invention.
Figure 12:
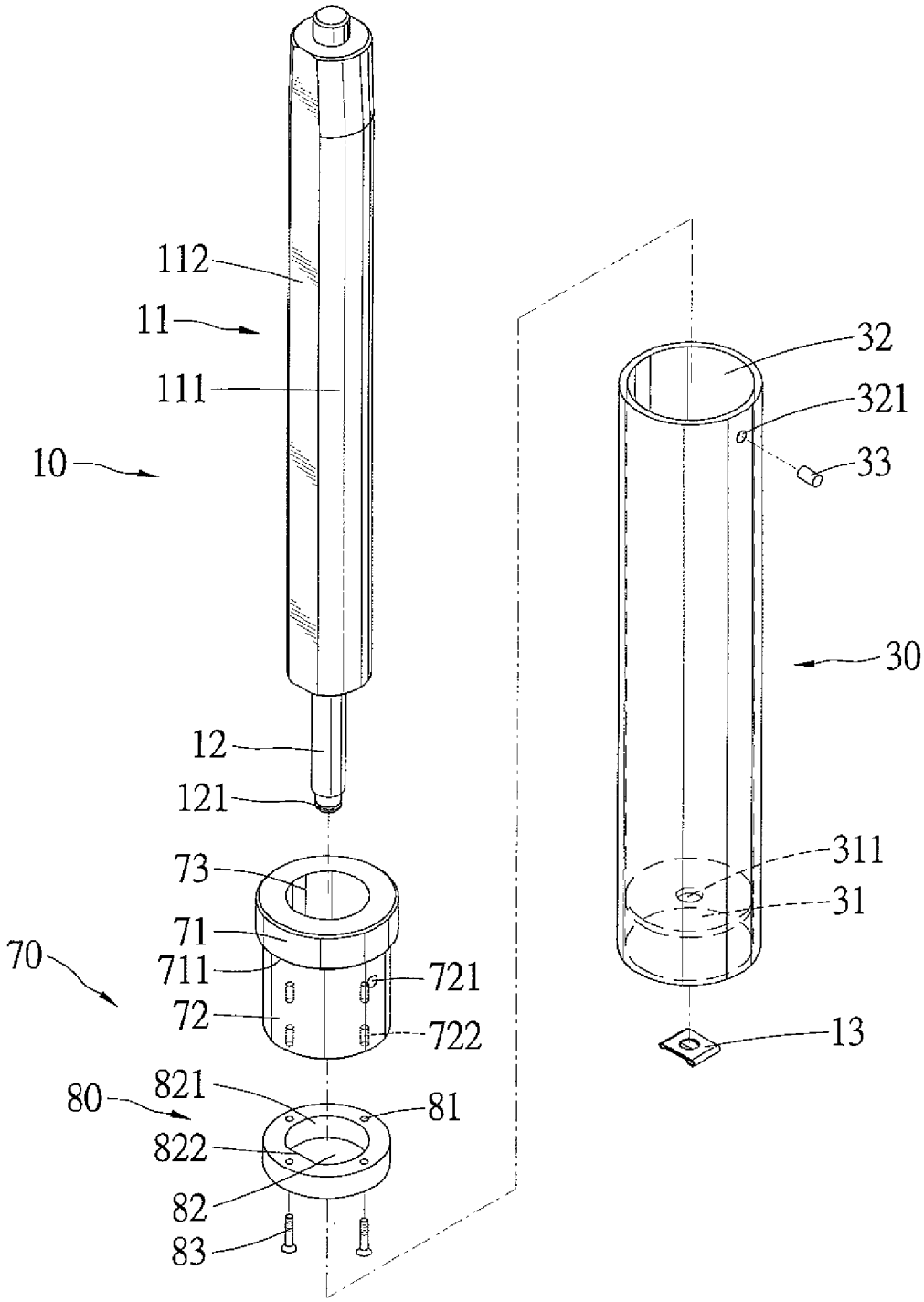
FIG. 12 is an exploded view of the pneumatic lift apparatus shown in FIG. 11.
Figure 13:
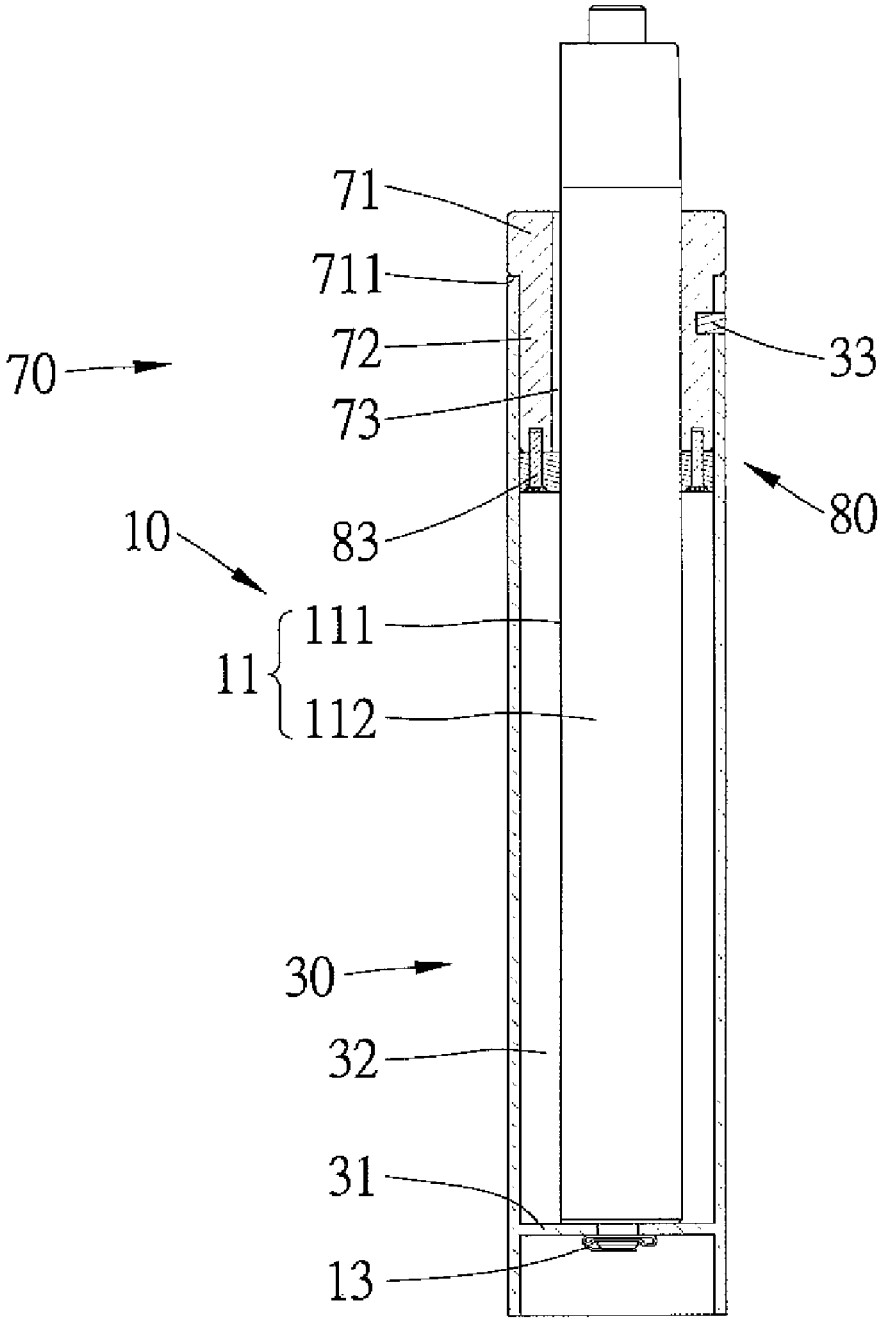
FIG. 13 is a cross-sectional view taken along 13-13 in FIG. 11.

Referring to FIGS. 11 through 13, a pneumatic lift apparatus in accordance with a fourth embodiment in the present invention includes the main body 10, a restricting device 70 and the housing 30. In this embodiment, the main body 10 and the housing means 30 are the same to that in the first embodiment, but the restricting device 70 replaces the restricting device 20. The restricting device 70 is preferably made of plastics, rubber or a material with plasticity and includes a first end 71 and a second end 72. Each of the cross-sections of the outer periphery of the first and second ends 71 and 72 is a perfect circle. The second end 72 of the restricting device 70 fits inside the receptacle 32. A through-hole 73 longitudinally pierces the restricting device 70 through the first end 71 to the second end 72. The cross-section of the through-hole 73 is a perfect circle.

An outer diameter of the first end 71 is larger than that of the second end 72 so that the difference between the diameter of the first and second ends 71 and 72 forms an abutted periphery 711 defined on the first end 71. An orifice 721 is provided on the outer periphery of the second end 72 axially and does not communicate with the through-hole 73. A plurality of engaging holes 722 is longitudinally formed and arranged with an annular array on the second end 72 of the restricting device 70, with each engaging hole 722 being open outwardly from the second end 72 of the restricting device 70. The restricting device 70 can be made via injection-molding so that the manufacturing process of the restricting device 70 is quick and economical.

A restricting element 80 which is further attached to the second end 72 of the restricting device 70 is preferably made of metal and in an annular form, with the cross-section of the outer periphery of the restricting element 80 being a perfect circle, and with the outer diameter of the restricting element 80 equal to that of the restricting device 70. A through-hole 82, which is related to the through-hole 73 of the restricting device 70, longitudinally pierces the restricting element 80. An arcuate portion 821 and a flat portion 822 form the periphery of the through-hole 82 and correspond to the arcuate portion 111 and the flat portion 112, respectively. A plurality of engaging holes 81 longitudinally pierces the restricting element 80 and is arranged around the circumference of the through-hole 82, with the engaging holes 81 respectively corresponding to the engaging holes 722 of the restricting device 70. An engaging element 83 is provided to insert through each engaging hole 81 to the related engaging hole 722 from the bottom of the restricting element 80 as to engage the restricting element 80 to the second end 72 of the restricting device 70.

The restricting device 70 that is coupled with the restricting element 80 is mounted on the second end of the housing 30, and the orifice 321 of the housing 30 corresponds to the orifice 721 of the restricting device 70. The fixed element 33 is adapted for inserting through the orifice 321 of the housing 30 to the orifice 721 of the restricting device 70 as to fix the restricting device 70 with the restricting element 80 to the housing 30 and prevent disengagement of the restricting device 70 with the restricting element 80 from the housing 30. The resilience of the restricting device 70, also, can increase the attachment force between the restricting device 70 and the housing 30. Further, the abutted periphery 611 is adapted to abut with the second end of the housing 30 for preventing the whole restricting device 70 with the restricting element 80 from sliding into the receptacle 32.

The main body 10 is inserted through the restricting device 70 and the restricting element 80 to the receptacle 32 of the housing 30. Incorporation of the restricting device 70 and the restricting element 80 is engaged with the body tube 11 in place, and the main body 10 is slidably coupled with the restricting device 70 and the restricting element 80 so that the body tube 11 is allowed to move longitudinally relative to the restricting device 70. While the main body 10 is engaging with the restricting device 70 and the restricting element 80, the flat portion 822 abuts with the flat portion 112 of the body tube 11 with a line-contact so that the body tube 11 is restricted not to rotate relative to the restricting device 70.

What is claimed is:

1. A pneumatic lift apparatus comprising:

a main body including a body tube, with a cross-section of the body tube being neither a perfect circle nor a polygon, wherein the body tube includes an arcuate portion and a flat portion on an outer circumference thereof, with the arcuate portion and the flat portion contiguously connected to each other;

a restricting device slidably mounted on the body tube of the main body, wherein the restricting device includes a first end, a second end, a through-hole and a groove piercing therethrough longitudinally and a flat piece disposed in the groove, with the flat piece abutting with the flat portion of the body tube, with the body tube restricted not to rotate relative to the restricting device; and a housing, wherein the restricting device is coupled to an end of the housing, with the main body inserted through the restricting device and received in the housing, with the main body fixed in the housing opposite to the restricting device.

2. The pneumatic lift apparatus as claimed in claim 1, wherein the housing further comprises a receptacle having an outer wall, an orifice defined on the outer wall of the receptacle adjacent to the restricting device and a fixed element; wherein the restricting device comprises an orifice provided on an outer periphery of the second end of the restricting device axially and that does not communicate with the through-hole of the restricting device, with the fixed element inserted through the orifice of the housing means to the orifice of the restricting device.

3. The pneumatic lift apparatus as claimed in claim 1, with the flat piece of the restricting device made of metal.

4. The pneumatic lift apparatus as claimed in claim 1, with the restricting device made of plastic or rubber.

5. A pneumatic lift apparatus comprising:

a main body including a body tube, with a cross-section of the body tube being neither a perfect circle nor a polygon, wherein the body tube includes an arcuate portion and a flat portion on an outer circumference thereof, with the arcuate portion and the flat portion contiguously connected to each other;

a restricting device slidably mounted on the body tube of the main body, wherein the restricting device includes a first end, a second end, a first through-hole piercing therethrough longitudinally and a fixed pin inserted thereto and communicated with the first through-hole, with the fixed pin abutted against the flat portion of the body tube for preventing the body tube from rotating relative to the restricting device, with the body tube restricted not to rotate relative to the restricting device; and a housing, wherein the restricting device is coupled to an end of the housing, with the main body inserted through the restricting device and received in the housing, with the main body fixed in the housing opposite to the restricting device.

6. The pneumatic lift apparatus as claimed in claim 5, wherein the restricting device includes a second through-hole transversely piercing the second end of the restricting device, with the fixed pin disposed in the second through-hole, with the fixed pin abutting with the flat portion of the body tube with a line-contact.

7. The pneumatic lift apparatus as claimed in claim 5, wherein the housing further comprises a receptacle having an outer wall, an orifice defined on the outer wall of the receptacle adjacent to the restricting device and a fixed element; wherein the restricting device comprises an orifice provided on an outer periphery of the second end of the restricting device axially and does not communicate with the through-hole of the restricting device, with the fixed element inserted through the orifice of the housing means to the orifice of the restricting device.

8. The pneumatic lift apparatus as claimed in claim 5, with the restricting device made of plastic or rubber.

9. A pneumatic lift apparatus comprising:

a main body including a body tube, with a cross-section of the body tube being neither a perfect circle nor a polygon, wherein the body tube includes an arcuate portion and a flat portion on an outer circumference thereof with the arcuate portion and the flat portion contiguously connected to each other;

a restricting device slidably mounted on the body tube of the main body, wherein the restricting device includes a first end, a second end, a first through-hole piercing therethrough longitudinally and a restricting element installed to the bottom of the second end of the restricting device; wherein the restricting element includes a through-hole which is related to the through-hole of the restricting device longitudinally pierces the restricting element, with an arcuate portion and a flat portion forming the periphery of the through-hole of the restricting element and corresponding to the arcuate portion and flat portions of the body tube, respectively, with the body tube restricted not to rotate relative to the restricting device; and a housing, wherein the restricting device is coupled to an end of the housing, with the main body inserted through the restricting device and received in the housing, with the main body fixed in the housing opposite to the restricting device.

10. The pneumatic lift apparatus as claimed in claim 9, wherein the housing further comprises a receptacle having an outer wall, an orifice defined on the outer wall of the receptacle adjacent to the restricting device and a fixed element; wherein the restricting device comprises an orifice provided on an outer periphery of the second end of the restricting device axially and does not communicate with the through-hole of the restricting device, with the fixed element inserted through the orifice of the housing means to the orifice of the restricting device.

11. The pneumatic lift apparatus as claimed in claim 9, with the restricting element made of metal.

12. The pneumatic lift apparatus as claimed in claim 9, with the restricting device made of plastic or rubber.

13. A pneumatic lift apparatus comprising:

a main body including a body tube, with a cross-section of the body tube being neither a perfect circle nor a polygon;

a restricting device slidably mounted on the body tube of the main body, with the body tube restricted not to rotate relative to the restricting device; and a housing comprising a limited portion formed therein and an aperture defined on a center of the limited portion, wherein the main body further comprises a connected rod slidably received in the body tube and a connected element for fixing the connected rod to the housing, wherein the restricting device is coupled to an end of the housing, with the main body inserted through the restricting device and received in the housing, with the main body fixed in the housing opposite to the restricting device;

wherein while the main body is received in the housing, the body tube is abutted against the limited portion and the connected rod is engaged with the aperture via the connected element.

14. The pneumatic lift apparatus as claimed in claim 13, with the connected rod including a connected end inserted through the aperture for engaging with the connected element.

* * * * *